US010156400B2

(12) United States Patent
Nakamura et al.

(10) Patent No.: US 10,156,400 B2
(45) Date of Patent: Dec. 18, 2018

(54) HEAT EXCHANGER AND REFRIGERATION CYCLE DEVICE

(71) Applicant: Mitsubishi Electric Corporation, Tokyo (JP)

(72) Inventors: Shin Nakamura, Tokyo (JP); Hideaki Maeyama, Tokyo (JP); Akira Ishibashi, Tokyo (JP); Shinya Higashiue, Tokyo (JP); Daisuke Ito, Tokyo (JP); Shigeyoshi Matsui, Tokyo (JP); Yuki Ugajin, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/526,829

(22) PCT Filed: Jan. 30, 2015

(86) PCT No.: PCT/JP2015/052753
§ 371 (c)(1),
(2) Date: May 15, 2017

(87) PCT Pub. No.: WO2016/121115
PCT Pub. Date: Aug. 4, 2016

(65) Prior Publication Data

US 2017/0336145 A1 Nov. 23, 2017

(51) Int. Cl.
*F28D 1/047* (2006.01)
*F28F 1/02* (2006.01)
(Continued)

(52) U.S. Cl.
CPC ..... *F28D 1/047* (2013.01); *F25B 47/025* (2013.01); *F28D 1/0417* (2013.01);
(Continued)

(58) Field of Classification Search
CPC ..... F25D 17/06; F25D 23/00; F28D 1/047; F28F 13/06; F28F 1/02; F28F 1/32
See application file for complete search history.

(56) References Cited

U.S. PATENT DOCUMENTS

2006/0048928 A1* 3/2006 Maezawa ..... F25B 39/00 165/173
2013/0240176 A1* 9/2013 Lee ..... F25B 29/00 165/59
2015/0083377 A1 3/2015 Jindou et al.

FOREIGN PATENT DOCUMENTS

GB 2 299 656 A 10/1996
GB 2299656 A * 10/1996
(Continued)

OTHER PUBLICATIONS

International Search Report of the International Searching Authority dated Apr. 7, 2015 for the corresponding international application No. PCT/JP2015/052753 (and English translation).
(Continued)

*Primary Examiner* — Emmanuel Duke
(74) *Attorney, Agent, or Firm* — Posz Law Group, PLC

(57) ABSTRACT

In a heat exchanger, a first heat exchange unit is formed by curving a third heat exchange unit having a planar shape through L-shape bending, and a second heat exchange unit is formed by curving a fourth heat exchange unit having a planar shape through the L-shape bending, independently of the third heat exchange unit. The first heat exchange unit and the second heat exchange unit are arranged so as to be opposed to each other along a corner portion between adjacent two side surfaces of a casing.

3 Claims, 7 Drawing Sheets

(51) Int. Cl.

| | |
|---|---|
| ***F28F 1/32*** | (2006.01) |
| ***F28F 13/06*** | (2006.01) |
| ***F25B 47/02*** | (2006.01) |
| ***F28F 9/26*** | (2006.01) |
| ***F28D 1/04*** | (2006.01) |
| *F28D 21/00* | (2006.01) |

(52) U.S. Cl.
CPC ..... *F28D 1/0471* (2013.01); *F28F 1/02* (2013.01); *F28F 1/32* (2013.01); *F28F 9/262* (2013.01); *F28F 13/06* (2013.01); *F28D 2021/0068* (2013.01)

(56) References Cited

FOREIGN PATENT DOCUMENTS

| | | | |
|---|---|---|---|
| JP | S56-152276 | U1 | 4/1980 |
| JP | S61-046865 | A | 3/1986 |
| JP | 02-241620 | A | 9/1990 |
| JP | 3068687 | B2 | 6/1993 |
| JP | H08-136007 | A | 5/1996 |
| JP | 08-270985 | A | 10/1996 |
| JP | 09-276940 | A | 10/1997 |
| JP | 2000-088291 | A | 3/2000 |
| JP | 2000-205602 | A | 7/2000 |
| JP | 2002-228290 | A | 8/2002 |
| JP | 2003-279073 | A | 10/2003 |
| JP | 2008-261552 | A | 10/2008 |
| WO | 2013/161311 | A1 | 10/2013 |

OTHER PUBLICATIONS

Office Action dated Jan. 9, 2018 issued in corresponding JP patent application No. 2016-571646 (and English translation).
Office action dated Jun. 21, 2018 issued in corresponding CN patent application No. 2015800644016 (and English machine translation thereof).

* cited by examiner

HEAT EXCHANGER AND REFRIGERATION CYCLE DEVICE

CROSS REFERENCE TO RELATED APPLICATION

This application is a U.S. national stage application of PCT/JP2015/052753 filed on Jan. 30, 2015, the disclosure of which is incorporated herein by reference.

TECHNICAL FIELD

The present invention relates to a heat exchanger and a refrigeration cycle apparatus.

BACKGROUND ART

As a heat exchanger constructing a refrigeration cycle apparatus, there exists a heat exchanger including a heat transfer pipe having a circular shape. A diameter of the heat transfer pipe is progressively reduced for the purpose of achieving higher performance of the heat exchanger. In recent years, there even exists a heat exchanger including a flat perforated pipe used as the heat transfer pipe.

When a small-diameter circular pipe, for example, having a diameter of 4 mm or the like, or a flat perforated pipe is used as the heat transfer pipe, a flow passage sectional area of the small-diameter circular pipe or the flat perforated pipe is smaller than a flow passage sectional area of a normal circular pipe. Therefore, when the heat exchanger is formed with the number of passes equal to that in a mode in which the heat transfer pipe being a normal circular pipe is used, a pressure loss inside the heat transfer pipe is increased to lower operation efficiency of a refrigeration cycle.

Reduction of the pressure loss can be achieved by increasing the number of passes of the heat exchanger or reducing a length of the heat transfer pipe for one pass. When, for example, a related-art heat exchanger disclosed in Patent Literature 1 is operated as a condenser, in a main heat exchanger installed in an upper part, after a refrigerant is multi-branched at a header, the refrigerants are caused to flow in parallel. The refrigerants are condensed to cause a phase change from a gas refrigerant into a two-phase refrigerant having a large ratio of a liquid phase. After the refrigerants are re-joined together at a return header on an opposite side, the number of passes is reduced, and a flow rate is increased in a sub-heat exchanger installed in a lower part. Then, subcooling processing from the two-phase refrigerant into a liquid refrigerant is performed. Meanwhile, when the heat exchanger is used as an evaporator, the refrigerant flows from the sub-heat exchanger, and the two-phase refrigerant is evaporated into the gas refrigerant in the main heat exchanger. The sub-heat exchanger has a small number of passes. Thus, the pressure loss is large, and the amount of heat exchange with air is small. However, the sub-heat exchanger can increase a temperature of the refrigerant. As a result, condensed water remaining in the lower part can be prevented from turning into robust ice gorge (root ice) to break the heat transfer pipe or a fin.

CITATION LIST

Patent Literature

[PTL 1] WO 2013/161311 A1

SUMMARY OF INVENTION

Technical Problem

When a multi-row heat exchanger includes a curved portion, fin buckling is liable to occur when the heat exchanger is bent, with the result that performance and manufacturability is disadvantageously lowered. In particular, the heat exchanger using the heat transfer pipe such as the flat perforated pipe has a flat shape. Therefore, a sectional secondary moment becomes larger. As a result, a bending moment required for bending the heat exchanger becomes larger. Thus, a problem of occurrence of the fin buckling becomes noticeable.

The present invention has an object to provide a heat exchanger capable of reducing occurrence of fin buckling.

Solution to Problem

In order to achieve the above-mentioned object, according to one embodiment of the present invention, there is provided a heat exchanger, including: a first heat exchange unit; and a second heat exchange unit, the first heat exchange unit and the second heat exchange unit being housed within a casing and each including a fin and a heat transfer pipe, the first heat exchange unit being formed by curving a third heat exchange unit having a planar shape through L-shape bending, the second heat exchange unit being formed by curving a fourth heat exchange unit having a planar shape through the L-shape bending, independently of the third heat exchange unit, the first heat exchange unit and the second heat exchange unit being arranged so as to be opposed to each other along a corner portion between adjacent two side surfaces of the casing.

Further, in order to achieve the same object, according to one embodiment of the present invention, there is provided a heat exchanger, including: a first heat exchange unit; and a second heat exchange unit, the first heat exchange unit and the second heat exchange unit being housed within a casing and each including a fin and a heat transfer pipe, the second heat exchange unit including a curved portion arranged along a corner portion between two side surfaces and a planar portion adjacent to the curved portion, the first heat exchange unit having a planar shape and being arranged so as to be opposed to the planar portion.

Advantageous Effects of Invention

According to the present invention, the heat exchanger capable of reducing the occurrence of the fin buckling can be provided.

DESCRIPTION OF EMBODIMENTS

Figure 1:
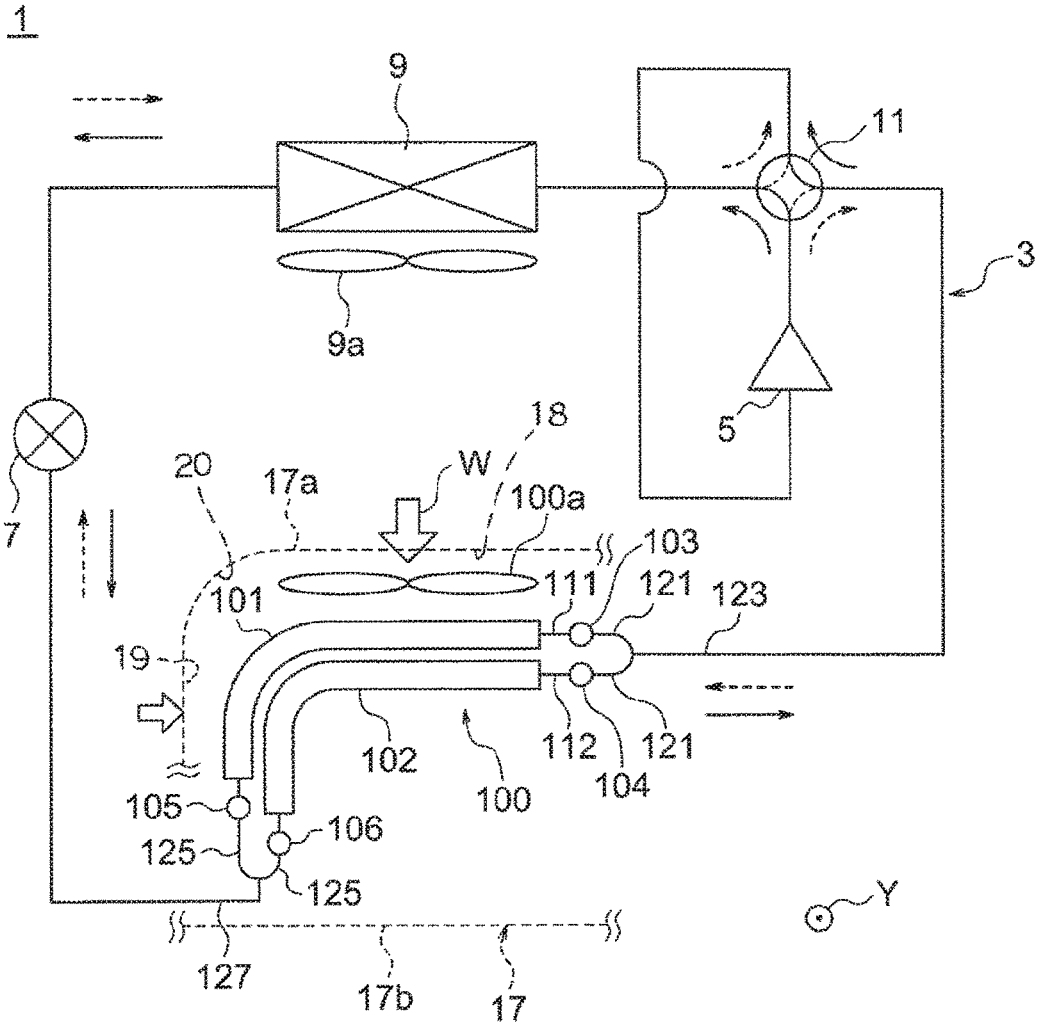
FIG. 1 is a view for illustrating a configuration of a refrigeration cycle apparatus according to a first embodiment of the present invention.

Now, embodiments of the present invention are described with reference to the accompanying drawings. Note that, in the drawings, the same reference symbols represent the same or corresponding parts.

First Embodiment

FIG. 1 is a view for illustrating a configuration of a refrigeration cycle apparatus according to a first embodiment of the present invention. A refrigeration cycle apparatus 1 includes a circuit 3 through which a refrigerant circulates. The circuit 3 includes at least a compressor 5, an outdoor heat exchanger 100, an expansion unit 7, and an indoor heat exchanger 9.

The refrigeration cycle apparatus 1 can perform both a heating operation and a cooling operation, that is, a defrosting operation. The circuit 3 includes a four-way valve 11 configured to perform switching between the operations. Further, in FIG. 1, flow of the refrigerant during the cooling operation, that is, the defrosting operation is indicated by the dotted line arrows, and flow of the refrigerant during the heating operation is indicated by the solid line arrows.

The components of the circuit 3 are described based on a direction of the flow of the refrigerant during the cooling operation as a reference. In the description of this application, the terms "inlet" and "outlet" are used based on the direction of the flow of the refrigerant during the cooling operation as the reference.

First, an outlet of the compressor 5 is connected to an inlet of the outdoor heat exchanger 100 via the four-way valve 11. An outlet of the outdoor heat exchanger 100 is connected to an inlet of the expansion unit 7. The expansion unit 7 is constructed by, for example, an expansion valve.

An outlet of the expansion unit 7 is connected to an inlet of the indoor heat exchanger 9. An outlet of the indoor heat exchanger 9 is connected to an inlet of the compressor 5 via the four-way valve 11.

In FIG. 1, the arrow W indicates flow of a fluid that exchanges heat with the refrigerant. As a specific example, the arrow W indicates flow of air that exchanges heat with the refrigerant. The same applies to FIG. 2 to FIG. 7 referred to later.

On a windward side of the indoor heat exchanger 9, a fan 9*a* is provided. By the fan 9*a*, the flow of the air to the indoor heat exchanger 9 is actively generated. The indoor heat exchanger 9 and the fan 9*a* are housed within a case of an indoor unit 15. The indoor unit 15 is arranged in an indoor space.

Meanwhile, on a windward side of the outdoor heat exchanger 100, a fan 100*a* is provided. The fan 100*a* actively generates the flow W of air to the outdoor heat exchanger 100. The outdoor heat exchanger 100, the fan 100*a*, the compressor 5, the expansion unit 7, and the four-way valve 11 are housed within a case 17 of an outdoor unit.

Figure 2:
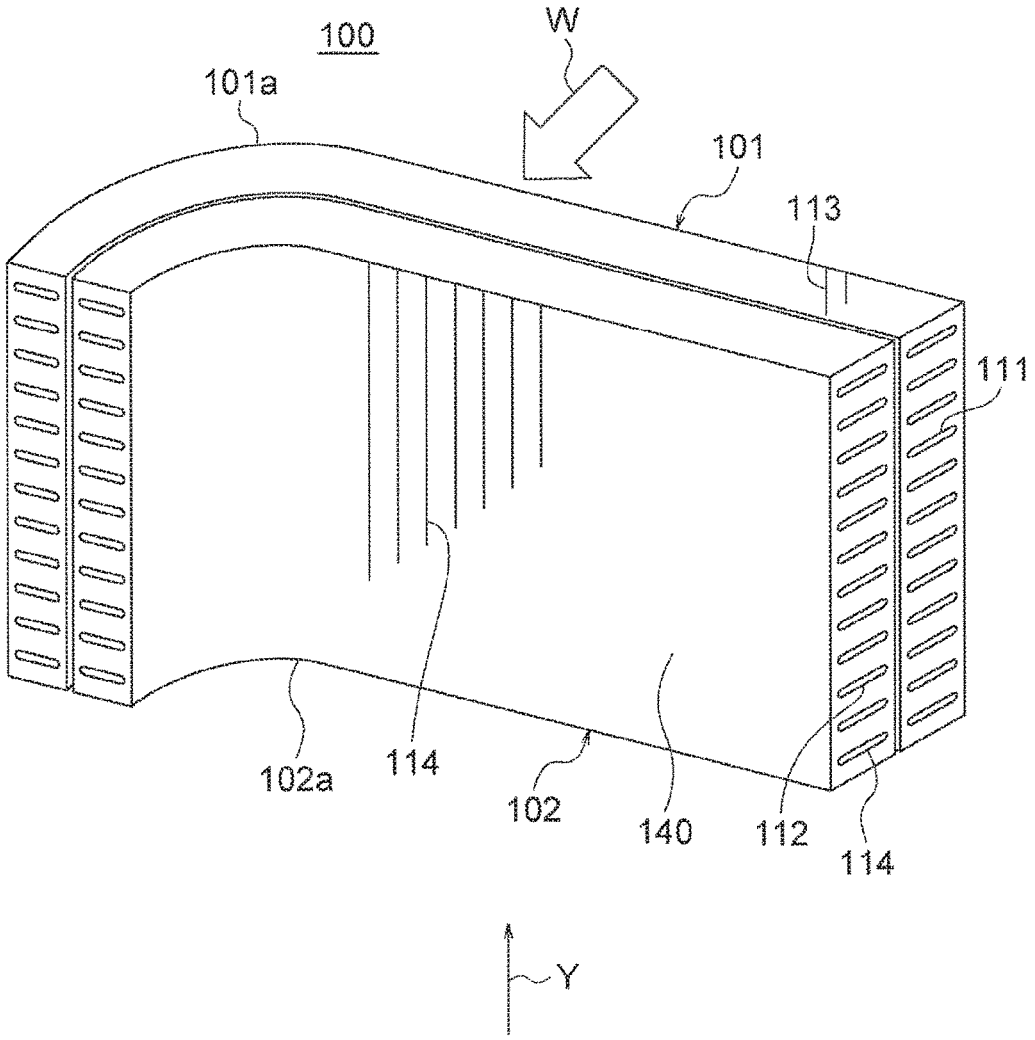
FIG. 2 is a perspective view of an outdoor heat exchanger according to the first embodiment of the present invention.

With reference to FIG. 1 and FIG. 2, details of the outdoor heat exchanger 100 are described. FIG. 2 is a perspective view of the outdoor heat exchanger. In order to prioritize clarity of the drawing, an illustration of fins described below is omitted in FIG. 1.

The outdoor heat exchanger 100 includes a windward row (first row) 101 being a first heat exchange unit and a leeward row (second row) 102 being a second heat exchange unit. The windward row 101 includes a plurality of windward heat transfer pipes (first heat transfer pipes) 111 made of aluminum and a plurality of windward fins (first fins) 113 made of aluminum, which intersect the plurality of windward heat transfer pipes 111. The leeward row 102 includes a plurality of leeward heat transfer pipes (second heat transfer pipes) 112 made of aluminum and a plurality of leeward fins (second fins) 114 made of aluminum, which intersect the plurality of leeward heat transfer pipes 112. Each of the plurality of windward heat transfer pipes 111 and the plurality of leeward heat transfer pipes 112 is a flat pipe or a circular pipe having a diameter of 4 mm or smaller.

The windward row 101 and the leeward row 102 are arranged in a direction along the flow W of air that exchanges heat with the refrigerant, that is, an arrayed direction.

The windward row 101 is closer to an air intake surface 17*a* of the case (casing) 17 of the outdoor unit than the leeward row 102. In other words, the leeward row 102 is closer to an air exhaust surface 17*b* provided to the case (casing) 17 of the outdoor unit than the windward row 101. Specifically, the first heat exchange unit is arranged on the windward side with respect to an airflow generated by an operation of the fan housed within the casing as compared with the second heat exchange unit.

In the windward row 101, the plurality of windward heat transfer pipes 111 are arranged in a vertical direction Y that is perpendicular to the arrayed direction. Similarly, in the leeward row 102, the plurality of leeward heat transfer pipes 112 are arranged in the vertical direction Y that is perpendicular to the arrayed direction.

The plurality of windward fins 113 intersect the plurality of windward heat transfer pipes 111 in plan view. Similarly, the plurality of leeward fins 114 intersect the plurality of leeward heat transfer pipes 112 in plan view.

Inlet ends of the plurality of windward heat transfer pipes 111 are connected to a common windward inlet header (first windward header) 103, and outlet ends of the plurality of windward heat transfer pipes 111 are connected to a common windward outlet header (second windward header) 105. Further, inlet ends of the plurality of leeward heat transfer pipes 112 are connected to a common leeward inlet header (first leeward header) 104, and outlet ends of the plurality of leeward heat transfer pipes 112 are connected to a common leeward outlet header (second leeward header) 106.

The windward inlet header 103 and the leeward inlet header 104 are connected to a branch portion of an inlet collection pipe 123 via a plurality of, for example, two in the first embodiment, inlet distribution pipes 121. Further, the windward outlet header 105 and the leeward outlet header 106 are connected to a branch portion of an outlet collection pipe 127 via a plurality of, for example, two in the first embodiment, outlet distribution pipes 125.

The windward heat transfer pipes 111, the windward fins 113, the windward inlet header 103, and the windward outlet header 105 are integrated through brazing. Similarly, the leeward heat transfer pipes 112, the leeward fins 114, the leeward inlet header 104, and the leeward outlet header 106 are also integrated through brazing.

Next, an operation of the above-mentioned refrigeration cycle apparatus of the first embodiment is described. First, the heating operation is described. During the heating operation, the refrigerant flows as indicated by the solid line arrows in FIG. 1. A high-temperature and high-pressure gas refrigerant fed from the compressor 5 passes through the four-way valve 111 to flow into the indoor heat exchanger 9. The refrigerant flowing into the indoor heat exchanger 9 is cooled through heat exchange with indoor air, and thereafter flows into the expansion unit 7 to be reduced in pressure. The low-temperature refrigerant reduced in pressure flows into the outdoor heat exchanger 100.

The refrigerant flowing into the outdoor heat exchanger 100 passes through the outlet collection pipe 127 and the branch portion illustrated in FIG. 1 to flow into the windward outlet header 105 and the leeward outlet header 106. The refrigerant flowing into the windward outlet header 105 and the refrigerant flowing into the leeward outlet header 106 flow separately into the plurality of windward heat transfer pipes 111 and the plurality of leeward heat transfer pipes 112. Then, the refrigerants are heated by the air sent by the fan 100*a* to be evaporated while flowing through the windward heat transfer pipes 111 and the leeward heat transfer pipes 112.

Thereafter, the evaporated refrigerants join together in the windward inlet header 103 and the leeward inlet header 104, and further pass through the branch portion to join together in the inlet collection pipe 123. The refrigerant flowing out of the outdoor heat exchanger 100 passes through the four-way valve 11 to return to the compressor 5. Specifically, the outdoor heat exchanger 100 in the first embodiment includes a plurality of rows arranged in a direction approximately parallel to the flow of the fluid (air) that exchanges heat with the refrigerant, that is, the arrayed direction so that the flows of the refrigerants in all the heat transfer pipes are set to the same direction over the plurality of rows for a direction approximately perpendicular to the flow of the fluid (air) that exchanges heat with the refrigerant. Specifically, the outdoor heat exchanger 100 is a multi-row direct-flow type heat exchanger.

In the first embodiment, the windward row 101 includes a first curved portion 101*a*, and the leeward row 102 includes a second curved portion 102*a*. An inner side of a curve of the first curved portion 101*a* and an inner side of a curve of the second curved portion 102*a* are both located on a side close to one surface 140 of the leeward row 102. Specifically, the windward row 101 and the leeward row 102 are curved so as to be opposed to each other.

Figure 3:
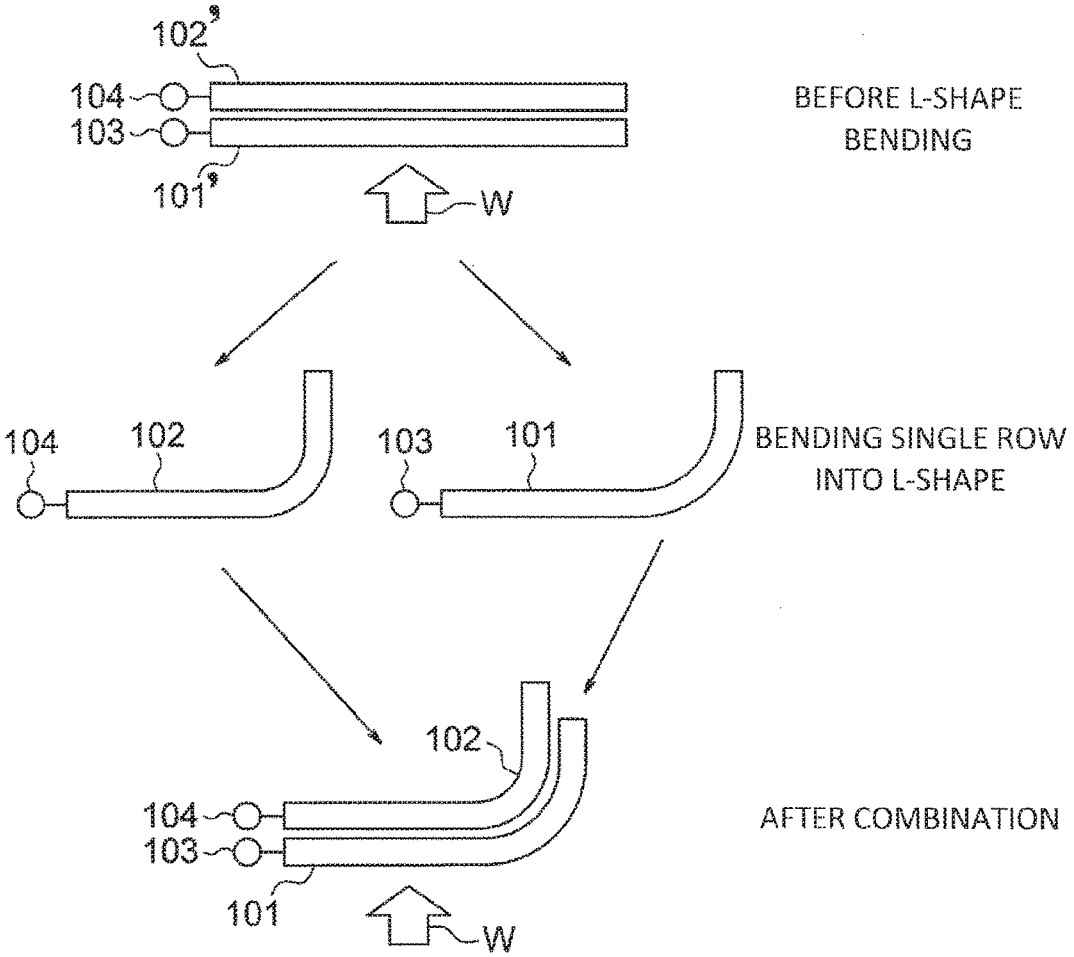
FIG. 3 is a plan view for illustrating an individual bending mode according to the first embodiment of the present invention.

As illustrated in FIG. 3, in the first embodiment, the windward row 101 and the leeward row 102 are curved individually. FIG. 3 is a plan view for illustrating an individual bending mode of the first embodiment of the present invention. Specific description is given with reference to FIG. 3. The windward row 101, which is the first heat exchange unit after deformation, is formed by curving a planar windward row 101', which is a third heat exchange unit before deformation, through L-shape bending. Further, the leeward row 102, which is the second heat exchange unit after deformation, is formed by curving a planar leeward row 102', which is a fourth heat exchange unit before deformation, through L-shape bending. Specifically, the second heat exchange unit is formed by curving the fourth heat exchange unit through L-shape bending, independently of the third heat exchange unit. Then, the windward row 101, which is the first heat exchange unit after deformation, and the leeward row 102, which is the second heat exchange unit after deformation, are arranged so as to be opposed to each other along a corner portion 20 (see FIG. 1) between two adjacent side surfaces 18 and 19 (see FIG. 1) of the casing 17. With such a configuration, in a case of a multi-row parallel flow heat exchanger as illustrated in FIG. 2, the refrigerant is distributed by the header. Therefore, the heat exchanger can be constructed by connecting only the headers to each other without connecting the heat transfer pipes between the rows. Therefore, as illustrated in FIG. 3, the windward row 101 and the leeward row 102 can be separately bent into the L-shape. Through bending of the windward row 101 and the leeward row 102 separately into the L-shape, influence of a compressive force and a frictional force between the rows, which are generated when the windward row and the leeward row are simultaneously bent into the L-shape, can be reduced. Further, a magnitude of a bending moment required for bending is proportional to the number of rows. Therefore, through individual bending of each row into the L-shape, the magnitude of the bending moment can also be reduced.

Figure 4:
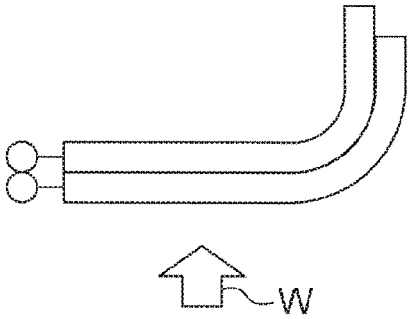
FIG. 4 is a view for illustrating a simultaneous bending mode as an explanatory example.

Further, when a plurality of the rows are simultaneously bent into the L-shape, a clearance cannot be formed between the rows, with the result that the rows are brought into contact with each other, as illustrated in FIG. 4. In particular, in a bent portion to which a force is liable to be applied because of bending, the degree of contact becomes larger. In this case, fin buckling occurs. As a result, a heat loss is disadvantageously generated in a contact portion, thereby lowering efficiency of the heat exchanger. In the mode in which each of the rows is individually bent as in the first embodiment, however, adjustment is performed, specifically, a radius of curvature of the curved portion of each of the rows is adjusted, so that the rows do not come into contact with each other when the shapes are combined with each other. As a result, the heat loss described above can be reduced. Thus, the heat exchanger can be used efficiently.

According to the first embodiment described above, there can be provided the heat exchanger capable of reducing the influence of the compressive force and the frictional force between the rows, which are generated along with the bending, to thereby reduce the occurrence of the fin buckling.

Second Embodiment

Figure 5:
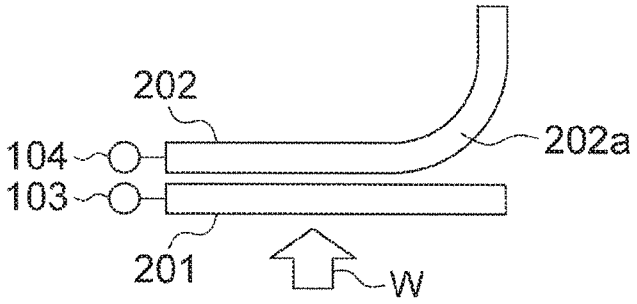
FIG. 5 is a plan view for illustrating a first bending mode according to a second embodiment of the present invention.
Figure 6:
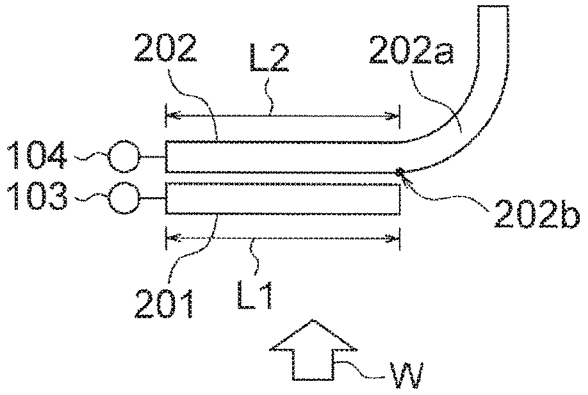
FIG. 6 is a plan view for illustrating a second bending mode according to the second embodiment of the present invention.

Next, with reference to FIG. 5 and FIG. 6, a second embodiment of the present invention is described. FIG. 5 is a plan view for illustrating a first bending mode of the second embodiment. FIG. 6 is a plan view for illustrating a second bending mode of the second embodiment. The second embodiment is similar to the above-mentioned first embodiment except for description given below.

In a first mode of the second embodiment, as illustrated in FIG. 5, only a leeward row (second row) 202 being the second heat exchange unit is bent, and a windward row (first row) 201 being the first heat exchange unit is not bent. Specifically, the leeward row 202 includes a leeward curved portion 202*a*, whereas the windward row 201 does not include a curved portion, specifically, extends straight in plan view.

Further, in a second mode of the second embodiment, as illustrated in FIG. 6, only the leeward row (second row) 202 is bent, whereas the windward row (first row) 201 is not bent. Specifically, the leeward row 202 includes the leeward curved portion 202*a*, whereas the windward row 201 does not include a curved portion, specifically, extends straight in plan view. Further, in the second mode, an extension length L1 of the windward row 201 is equal to or shorter than an extension length L2 of a straight portion of the leeward row 202, that is, a length from an end portion of the leeward curved portion 202*a* on a side opposite to a bending start portion 202*b*. Conversely, in the first mode, an extension length of the windward row 201 is longer than an extension length of the straight portion of the leeward row 202, as illustrated in FIG. 5.

Further, in both the first mode and the second mode of the second embodiment, the leeward row 202 extends to the leeward side in a curved manner.

In other words, in both the first mode and the second mode of the second embodiment, the second heat exchange unit includes the curved portion, specifically, leeward curved portion 202*a* arranged so as to extend along the corner portion 20 between the two side surfaces 18 and 19 of the casing 17 and a planar portion adjacent to the curved portion. The first heat exchange unit is formed into a planar shape and is arranged so as to be opposed to the planar portion.

Although a detailed illustration is omitted, in both the first mode and the second mode of the second embodiment, similarly to the first embodiment, the windward row 201 includes the plurality of windward heat transfer pipes and the plurality of windward fins intersecting the plurality of windward heat transfer pipes, and the leeward row 202 includes the plurality of leeward heat transfer pipes and the plurality of leeward fins intersecting the plurality of leeward heat transfer pipes.

According to the second embodiment configured as described above, there can be provided the heat exchanger capable of reducing the compressive force and the frictional force generated in the L-shaped bent portion between the rows, to thereby reduce the occurrence of the fin buckling. Further, such a heat exchanger can be manufactured simultaneously to have multiple rows, for example, two rows. Further, only the leeward row is bent, and thus an extension width, that is, an extension length of the heat exchanger can easily be adjusted.

Further, during furnace brazing of the heat exchanger, the header of the windward row and the header of the leeward row can be joined together. Therefore, the number of components to be subjected to torch brazing can be reduced. Thus, productivity can be improved.

Third Embodiment

Figure 7:
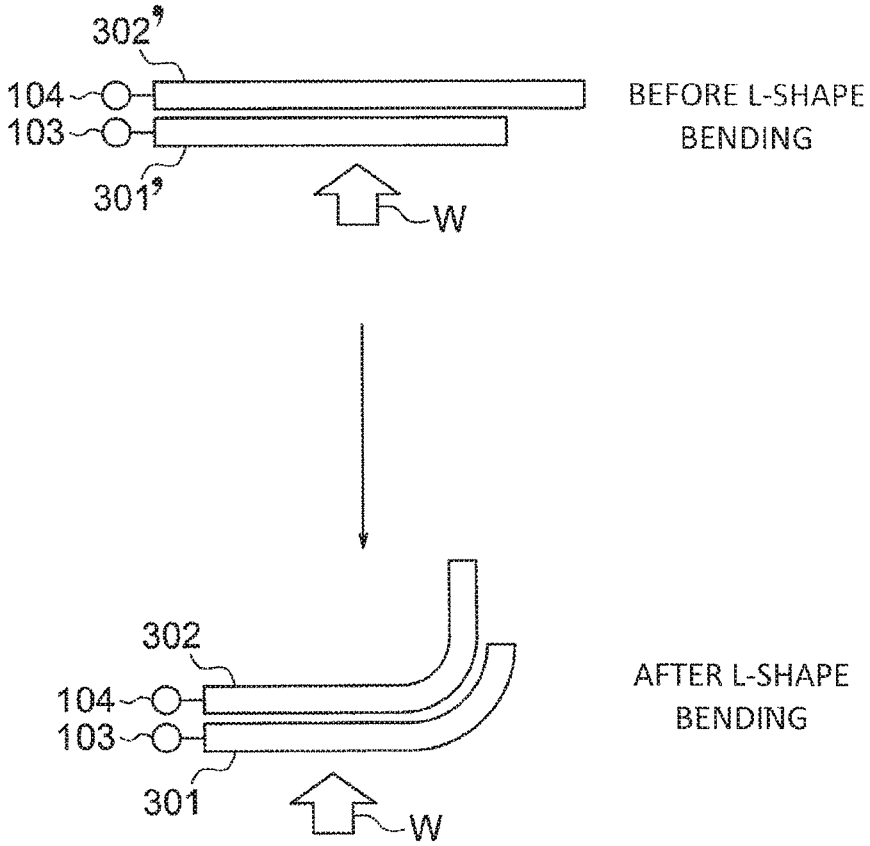
FIG. 7 is a plan view for illustrating characteristics of a heat exchanger according to a third embodiment of the present invention.

Next, with reference to FIG. 7, a third embodiment of the present invention is described. FIG. 7 is a plan view for illustrating characteristics of a heat exchanger according to the third embodiment of the present invention. The third embodiment is similar to the above-mentioned first embodiment except for description given below.

The third embodiment has a characteristic in that, as illustrated in FIG. 7, a length over which a windward row 301 being the first heat exchange unit extends is shorter than a length over which a leeward row 302 being the second heat exchange unit extends. In other words, the first heat exchange unit has a first planar portion opposed to the first side surface 18, which is one of the two side surfaces 18 and 19 of the casing 17, and the second heat exchange unit has a second planar portion opposed to the first side surface 18. A length (horizontal length) over which the first planar portion extends is shorter than a length (horizontal length) over which the second planar portion extends.

FIG. 7 is a view in which the characteristic of the third embodiment is applied to the above-mentioned characteristics of the first embodiment. Specifically, there is illustrated a case where the present invention is carried out for the heat exchanger in which both the windward row and the leeward row are finally bent. Therefore, when the characteristic of the third embodiment is provided to the characteristic of the second embodiment described above, that is, the mode in which only the leeward row is bent, the contents illustrated in FIG. 5 or the contents illustrated in FIG. 6 are obtained. According to the contents illustrated in FIG. 6, a length (horizontal length) over which the planar portion of the second heat exchange unit extends is longer than a length (horizontal length) over which the first heat exchange unit extends.

According to the third embodiment, the advantages of the first embodiment or the second embodiment described above are obtained. In addition, the following advantages are obtained. First, in the multi-row parallel flow heat exchanger, the flow of the refrigerant becomes a straight flow. The air flowing into the leeward row has already been subjected to the heat exchange with the refrigerant in the windward row. Thus, a temperature difference or an enthalpy difference between the air flowing into the leeward row and the refrigerant becomes smaller than a temperature difference or an enthalpy difference between the air flowing into the windward row and the refrigerant. As a result, there may arise a problem in that a difference is generated in the amount of heat exchange to prevent the same state of the refrigerant from being obtained on the outlet side of the heat transfer pipes. Specifically, there may arise a problem in that a region that cannot be used effectively as the heat exchanger is generated in each of the rows to lower the efficiency of the heat exchanger.

Meanwhile, in the third embodiment, the length over which the windward row extends is shorter than the length over which the leeward row extends. Therefore, a pressure loss in the windward row can be reduced to be smaller than a pressure loss in the leeward row so that a larger amount of refrigerant can be caused to flow in the windward row. Further, a heat transfer area of the leeward row becomes larger than a heat transfer area of the windward row. Therefore, the degree of inequality between a temperature difference or an enthalpy difference between the air flowing into the leeward row and the refrigerant and a temperature difference or an enthalpy difference between the air flowing into the windward row and the refrigerant can be reduced. Thus, a condition can be made closer to a condition under which a state of the refrigerant on the outlet side of the heat transfer pipes is uniform between the rows. Thus, the efficiency of the heat exchanger can be improved.

Although the details of the present invention are specifically described above with reference to the preferred embodiments, it is apparent that persons skilled in the art may adopt various modifications based on the basic technical concepts and teachings of the present invention.

In the above-mentioned embodiments, the refrigeration cycle apparatus that is an air conditioner is described. However, the present invention is not limited thereto. The present invention is widely applicable to a refrigeration cycle apparatus which includes a refrigeration circuit including a compressor, an expansion unit, an indoor heat exchanger, and an outdoor heat exchanger. Therefore, for example, the present invention can be carried out as a refrigeration cycle apparatus that is a water heater.

Further, in the above-mentioned embodiments, the outdoor heat exchanger is described as a heat exchanger having two rows. However, the present invention is not limited thereto. The present invention is also applicable to a heat exchanger having three or more rows. In this case, the present invention is carried out with the above-mentioned leeward row being a row closest to the leeward side in the heat exchanger having three or more rows.

The heat exchanger to which the present invention is applied may include a main heat exchanger unit and a sub-heat exchanger unit. In this case, when the heat exchanger is operated as a condenser, in a main heat exchanger installed in an upper part, after the refrigerant is multi-branched at a header, the refrigerants are caused to flow in parallel. The refrigerants are condensed to cause a phase change from a gas refrigerant into a two-phase refrigerant having a large ratio of a liquid phase. After the refrigerants are re-joined together at a return header on an opposite side, subcooling processing from the two-phase refrigerant into a liquid refrigerant is performed in a sub-heat exchanger installed in a lower part. Meanwhile, when the heat exchanger is used as an evaporator, the refrigerant flows from the sub-heat exchanger, and the two-phase refrigerant is evaporated into the gas refrigerant in the main heat exchanger.

REFERENCE SIGNS LIST

1 refrigeration cycle apparatus, 3 circuit, 5 compressor, 7 expansion unit, 9 indoor heat exchanger, 17 casing, 18, 19 side surface, 20 corner portion, 100 outdoor heat exchanger, 101, 201, 301 windward row (first heat exchange unit), 101' windward row (third heat exchange unit), 102, 202, 302 leeward row (second heat exchange unit), 102' leeward row (fourth heat exchange unit), 101*a* first curved portion, 102*a* second curved portion, 103 windward inlet header (first windward header), 104 leeward inlet header (first leeward header), 105 windward outlet header (second windward header), 106 leeward outlet header (second leeward header), 111 windward heat transfer pipe (first heat transfer pipe), 112 leeward heat transfer pipe (second heat transfer pipe), 113 windward fin (first fin), 114 leeward fin (second fin), 140 one surface

The invention claimed is:

1. A refrigeration cycle apparatus, comprising:

a circuit including a compressor, an outdoor heat exchanger, an expansion unit, and an indoor heat exchanger, the outdoor heat exchanger including a fan, a first heat exchanger, and a second heat exchanger arranged closer to a leeward side than the first heat exchanger with respect to an airflow generated by the fan, the first heat exchanger and the second heat exchanger being connected to a first collection pipe respectively through corresponding first distribution pipes, the first heat exchanger and the second heat exchanger being connected to a branch unit being one end of a second collection pipe respectively through corresponding second distribution pipes, another end of the second collection pipe being connected to the expansion unit, a length over which the first heat exchanger extends being shorter than a length over which the second heat exchanger extends, an amount of refrigerant in the first heat exchanger being larger than an amount of refrigerant in the second heat exchanger, and a heat transfer area of the second heat exchanger being larger than a heat transfer area of the first heat exchanger.

2. The refrigeration cycle apparatus according to claim 1, wherein the second heat exchanger includes a curved portion, and wherein the first heat exchanger extends straight in plan view without including a curved portion.

3. The refrigeration cycle apparatus according to claim 2, wherein the second heat exchanger includes a straight portion, and wherein an extension length L1 of the first heat exchanger is the equal to or shorter than an extension length L2 of the straight portion of the second heat exchanger.

* * * * *